US007374193B2

(12) United States Patent
Dunn

(10) Patent No.: US 7,374,193 B2
(45) Date of Patent: May 20, 2008

(54) TRANSPORTING APPARATUS AND TRAILER CONVERSION KIT AND METHOD

(75) Inventor: Larry W. Dunn, Anderson, SC (US)

(73) Assignee: Dunn Right Incorporated, Anderson, SC (US)

( * ) Notice: Subject to any disclaimer, the term of this patent is extended or adjusted under 35 U.S.C. 154(b) by 548 days.

(21) Appl. No.: 10/831,884

(22) Filed: Apr. 26, 2004

(65) Prior Publication Data

US 2005/0000929 A1 Jan. 6, 2005

Related U.S. Application Data

(63) Continuation-in-part of application No. 10/071,256, filed on Feb. 8, 2002, now Pat. No. 6,726,041.

(51) Int. Cl.
*B60P 3/10* (2006.01)

(52) U.S. Cl. ..... 280/414.1; 280/656; 280/789

(58) Field of Classification Search ..... 280/652, 280/414.1, 656, 482, 42, 47.331, 789; 298/5, 298/12; 296/57.1, 136.07, 77.1; 410/3
See application file for complete search history.

(56) References Cited

U.S. PATENT DOCUMENTS 2,491,417 A * 12/1949 Pflantz et al. ..... 298/5
4,126,324 A * 11/1978 Browning ..... 280/42
4,175,768 A * 11/1979 Thackray ..... 280/652
4,221,420 A * 9/1980 Vencill et al. ..... 280/414.1
4,480,851 A * 11/1984 St-Pierre ..... 280/656
4,511,181 A * 4/1985 Schantz ..... 298/5
4,813,841 A * 3/1989 Eischen ..... 298/12
4,872,728 A * 10/1989 Adams ..... 298/5
4,889,390 A * 12/1989 Campbell ..... 298/5
5,540,538 A * 7/1996 Head, Sr. ..... 298/5
5,544,944 A * 8/1996 Keech ..... 298/5
6,733,219 B1 * 5/2004 Floe ..... 296/57.1

* cited by examiner

*Primary Examiner*—Hau Phan
(74) *Attorney, Agent, or Firm*—Charles L. Schwab; Nexsen Pruet, LLC

(57) ABSTRACT

A conversion kit and method of using a conversion kit is provided which converts a metal shipping crate into a transporting apparatus. In one preferred embodiment, the conversion kit utilizes a hinge and locking mechanism to angle the trailer for loading of a cargo vehicle and lock the trailer into a horizontal transport position. In another preferred embodiment, the conversion kit utilizes a locking ramp which is lowered for loading of a cargo vehicle and then locked in a vertical position to keep a cargo vehicle in place. A method for using the conversion kit is also provided.

4 Claims, 5 Drawing Sheets

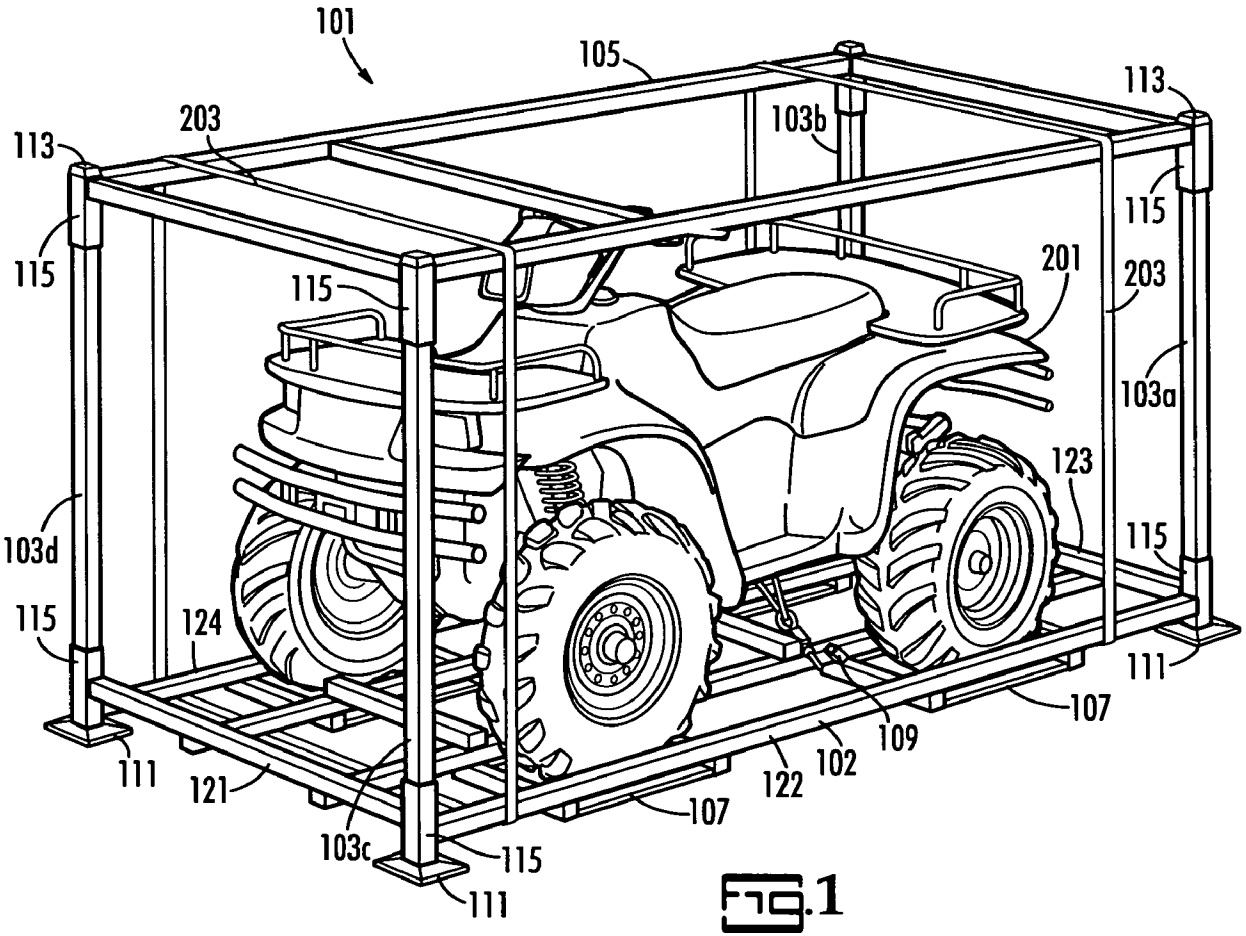
FIG. 1
AMENDED

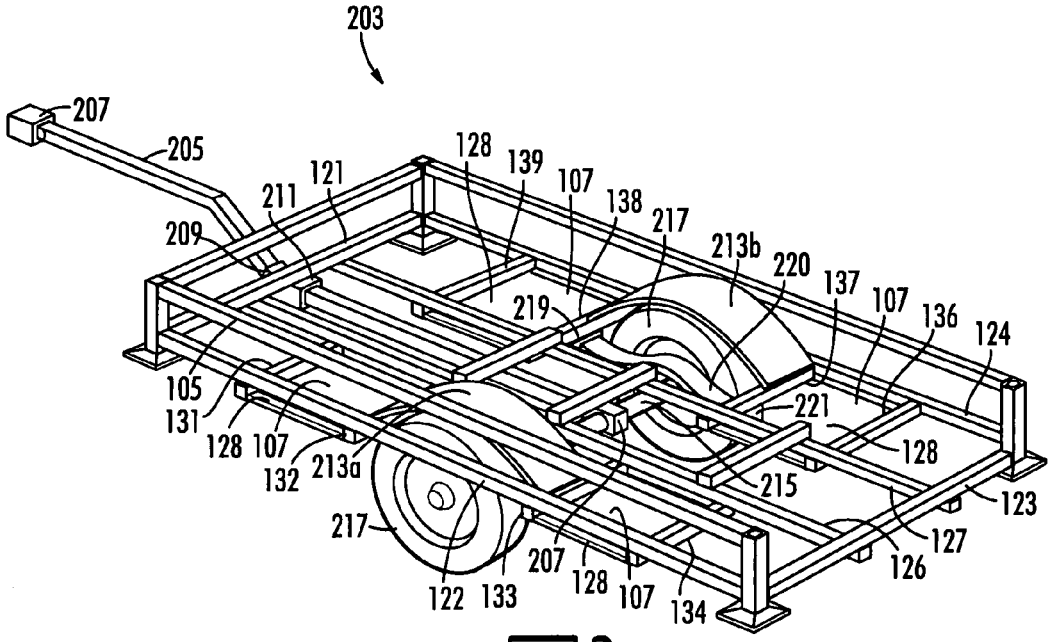
FIG. 2
AMENDED

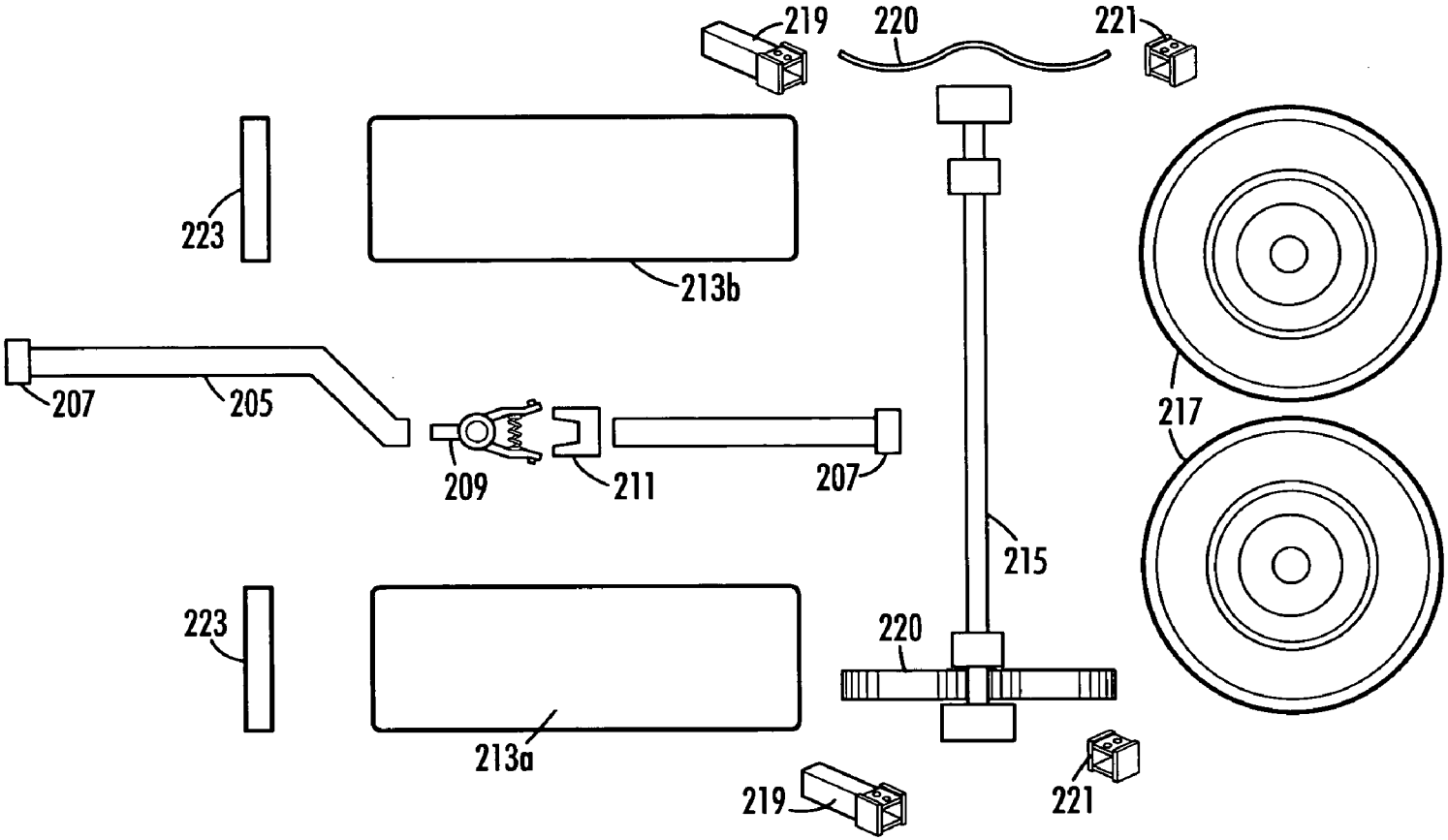
Fig.3
AMENDED

TRANSPORTING APPARATUS AND TRAILER CONVERSION KIT AND METHOD

CROSS-REFERENCE TO RELATED APPLICATIONS

This application is a continuation-in-part of prior U.S. application Ser. No. 10/071,256 filed on Feb. 8, 2002, now U.S. Pat. No. 6,726,041 titled "METAL SHIPPING CRATE." The entire content of the prior application is expressly incorporated herein by reference.

REFERENCE TO A MICROFICHE APPENDIX

Not applicable

FIELD OF INVENTION

The present invention generally relates to a conversion kit and method of using a conversion kit which converts a metal shipping crate into a transport trailer and more particularly to a conversion kit which utilizes a hinge and locking mechanism to angle a trailer for loading of the cargo vehicle and lock the trailer into a horizontal transport position, as well as a conversion kit which utilizes a locking ramp which is lowered for loading of cargo and then locked in a vertical position to keep cargo in place.

BACKGROUND OF THE INVENTION

When shipping manufactured articles, it is a common practice to enclose the articles in some sort of packaging. This is done for several reasons, the most common being protection of the contents. During transit, cargo left unprotected would be subject to damage from other items being transported in the same vehicle, or from being dropped. Cargo is also enclosed in square or rectangular packages to ease stacking and maximize the amount of cargo that can be hauled.

These reasons for packaging are especially relevant to large articles, such as "All-terrain vehicles" (ATVs) and personal watercraft such as Jet-Skis. These items are quite heavy and of such a shape to make stacking impossible. The items are also expensive and their appearance is paramount. Therefore, it is desirable to package these types of items so as to protect them from damage during transport and allow the items to be stacked and placed adjacent to each other with a minimal amount of space between them, so as to maximize the amount of items shipped and to minimize the shifting of such heavy cargo during the shipping process.

ATVs and personal watercraft vehicles (PWVs) are almost always stored in one location and used in another. Finding an economical, versatile means of transportation has been a challenge. The present invention converts a metal shipping container into a trailer, thereby giving the consumer a strong, versatile shipping crate and a means for transporting the contents of the crate after unpacking.

SUMMARY OF THE INVENTION

It is an object of the present invention to provide components which, after being bolted or welded to a metal shipping crate, converts the crate into a trailer suitable to safely haul the crate's former contents.

It is a further object of the present invention to provide components which, after being bolted or welded to a metal shipping crate, reduces waste and negative environmental impact by enabling an unneeded metal shipping crate to be reused as a trailer.

It is a further object of the present invention to provide a transporting apparatus which has an excellent strength to weight ratio due to the steel tubing which is the preferred embodiment of the invention.

It is a further object of the present invention to provide a transporting apparatus which tilts to easily receive cargo such as an ATV or PWV.

It is a further object of the present invention to provide a transporting apparatus with a rear ramp that opens into a position whereby the cargo may be easily loaded onto the apparatus, said ramp then being able to be raised and locked in a vertical position, thereby securing the cargo from sliding off the rear end of the apparatus.

BRIEF DESCRIPTION OF THE DRAWINGS

FIG. 1 is a perspective view of a metal shipping crate with an ATV secured inside.

FIG. 2 is a perspective view of a metal shipping crate after modification and application of a conversion kit to form a tilting transporting apparatus.

FIG. 3 is an exploded view of the main components of the conversion kit.

DETAILED DESCRIPTION OF PREFERRED EMBODIMENTS

Figure 4:
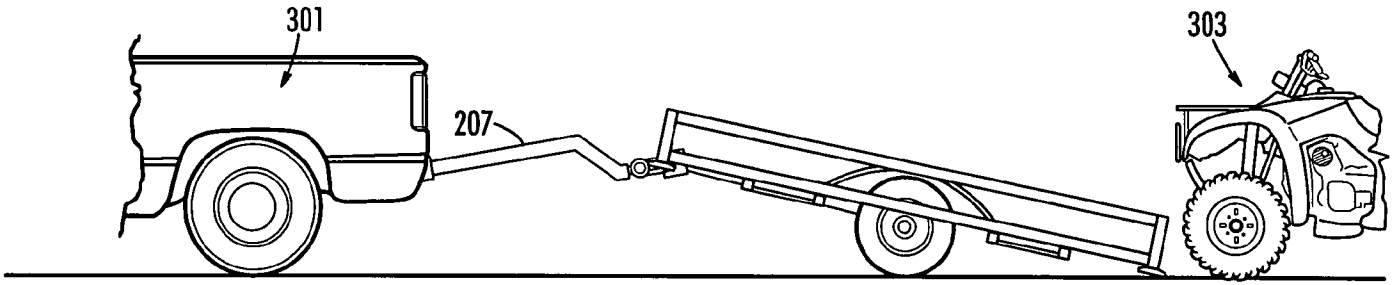
FIG. 4 is a perspective view of the tilting transporting apparatus tilted so as to receive cargo.

The present invention provides a transporting apparatus, trailer conversion kit, and method for converting a metal shipping crate into a sturdy trailer. The present invention adds value by using a shipping crate which otherwise would be discarded into a useful cargo carrier. The trailer is preferably constructed of tubular steel, which has a high strength-to-weight ratio. The trailer is quick and easy to load and unload, and the process of loading and unloading is error-proofed due to the design.

The present invention can be manifested in several configurations. One is a drive-on model. This model has no drive-up ramp. The user simply drives onto the unit, which is tilted with one end on the ground ready to receive the cargo. The user drives onto the lowered side, and as the user continues onto the trailer, the weight of the cargo raises the rear of the trailer and lowers the front. The front of the trailer automatically locks during loading due to a spring-loaded latch.

Another configuration is the rear ramp model. This design has a fixed tongue and a hinged rear ramp which allows for loading and unloading. The rear ramp has a self-locking design which allows the ramp to be locked in a vertical position. When so locked, the cargo is effectively held in place and no further straps or restraints are necessary. This is possible due to the shipping crate being designed to fit the cargo initially, and upon conversion the trailer provides a close fit. The hinged ramp model can also be constructed with a corner pocket adaptor, which allows for a wider loading area.

The rear ramp with its self-lock design make the invention very user-friendly. By the nature of the design, the loading and unloading process is error-proofed, and safety is the primary result. During transit, the upper rail of the trailer acts as a retainer preventing the item being hauled from shifting in any direction.

Referring to the drawing, and especially FIG. 1, the original shipping crate 101 is comprised of a bottom portion 102, intermediate portion such as four posts 103*a*-103*d*, and a top portion 105. The bottom portion 102 is comprised of tubular steel rails which are designed for strength and support. The bottom portion 102 is also designed in such a way as to be lifted, such as by a forklift, from any side. In other embodiments, the bottom portion 102 could be telescopically adjustable to accommodate various sizes of cargo. In the present embodiment, the metal tubing can simply be welded to accommodate different cargo.

The bottom portion 102 laterally outer horizontal side rails 122, 124 and laterally extending horizontal front and rear rails 121, 123. The rails 121, 122, 123, 124 form a rectangle, and are joined at the corners to a receptacle 115 and two longitudinally disposed inner rails 126, 127. A pair of intermediate longitudinal rail 126, 127, with ends secured to the end rails 121, 123, are spaced laterally inward from and are parallel to the laterally outer side rails 122, 124. The receptacle 115 serves as a corner post and also to receive and hold the intermediate portion 103*a*-103*d*. Joined to the receptacle 115 is a base 111. The base 111 serves as a base for the corner post and also operates to make stacking the crates more efficient and stable. The bottom portion 102 includes a support for the cargo such as wheel wells 107 for supporting a vehicle. These supports may be interchangeable. The illustrated wheel wells 107 are formed by laterally extending cross rails 131, 132, 133, 134, 136, 137, 138, 139 secured to underside of the longitudinally extending side rails 122, 124 and intermediate parallel longitudinal rails 126, 127, together with horizontal pans 128 secured to the underside of the cross rails 131, 132, 133, 134, 136, 137, 138, 139. The laterally inner intermediate rails 126, 127 are spaced laterally inward of said side rails 122, 124. The bottom portion 102 may further include connecting means 109 which can be adapted to receive bolts. These bolts could be attached to straps or other means which serve to hold the cargo securely to the bottom portion 102. By so securing the cargo, the crate 101 could be turned on its side or top and still protect the cargo.

The intermediate portion 103*a*-103*d* may be comprised of four tubular metal rails which serve as corner posts. The posts engage the receptacle 115 of the bottom portion 102 and are securely held.

The top portion 105 may be comprised of tubular metal rails, and has the same potential for modification as the bottom portion 102. The top portion contains a plurality of receptacles 115 which securely engage with the intermediate portion 103*a*-103*d*. The top portion 105 also has protrusions 113 which, when the crates are stacked, engage with the base 111 of the bottom portion of the crate above. This engagement serves to stabilize the stack.

A four-wheeled ATV is the cargo 201 which has been loaded onto the bottom portion 102 of the crate 101. The cargo 201 rests upon supports 107 of the bottom portion 102, such as wheel wells. The cargo 201 is secured via straps to the connecting means 109 of the bottom portion 102. Due to the ready access to the cargo 201, work such as painting touch-ups can be done on the cargo 201 without having to open the crate.

The intermediate portion 103*a*-103*d*, which in this embodiment are four tubular metal rails, are inserted into the receptacle 115 of the bottom portion 102. The top portion 105 is then placed such that the receptacle 115 of the top portion 105 engages with the intermediate portion 103*a*-103*d*. Straps 203 may be used to secure the crate 101 so that the top portion 105, intermediate portion 103*a*-103*d*, and bottom portion 102 do not disengage. Other embodiments of the invention can include partial enclosures for one or more sides of the crate when extra protection is needed.

FIG. 2 is a view of the metal shipping crate after modification and application of the conversion kit to form a tilting trailer 203. The trailer 203 is shown in the level transport position. The bottom portion 102 of the crate is essentially unchanged. The intermediate portions 103*a*-103*d* may be removed or shortened and are fixably attached to the bottom portion 102 and top portion 105. The top portion 105 is also essentially unchanged, with the exception of the removal of any supports which would prevent loading of the cargo, such as the portion of the top rail of the top portion 105 at the back of the trailer 203.

An outrigger is provided to attach the trailer 203 to a towing vehicle such as a truck. The outrigger 205 has at one end a mechanism for attaching the outrigger 205 to the towing vehicle. Such mechanisms are well known in the art. The other end of the outrigger 205 is outfitted with a hinge mechanism 207 which attaches to the bottom portion 102 of the crate and allows for tilting movement of the trailer 203. By use of the hinge mechanism, the construction of which is well-known in the art, the rear end of the trailer 203 may be lowered so that the rear end abuts the ground.

Also attached to the outrigger 205 is a locking mechanism 209, such as a spring clamp, which is designed to receiveably engage a plate attachment 211 which is fixably attached to the bottom portion 102. When the trailer 203 tilts such that the end nearest the towing vehicle is in the air and the opposite end is abutting the ground, the plate attachment 211 is in the air attached to the bottom portion 102 of the trailer 203.

Once the bottom portion 102 of the trailer 203 lowers due to the shifting weight of the cargo, the plate attachment 211 slides into the locking mechanism 209. By now engaging the locking mechanism 209, the plate attachment 211 is secured and the bottom portion 102 of the trailer 203 is no longer free to tilt. Such locking mechanisms 209 are well known in the art and may be manually or automatically engaged.

Arched wheel plates 213*a*-*b* are provided to allow the front wheels of the cargo vehicle to easily maneuver to the front wheel wells 107. An axle assembly 215, well known in the art, attaches to the bottom portion 102 of the trailer 203 so that wheels may be attached to the axle assembly 215 and be freely rotatable. The arched wheel plates 213*a*, 313*b* are secured at their front ends to cross rails 132, 138, respectively, and are secured at their rear ends to cross rails 133, 137, respectively, thus utilizing structure of the shipping crate 101 to support the arched wheel plates.

The bottom portion 102 is attached to the axle assembly 215 by a pair of leaf springs 220 mounted in front spring mounts 219 and rear spring mounts 221. The two front spring mounts 219 are attached to the cross bars 132, 138, respectively, and the two rear spring mounts 221 are attached to the cross bars 133, 137, respectively. Thus the cross bars 132 and 138 of the front wheel wells 107 and the cross bars 133, 137 of the rear wheel wells 107 support the wheel plates 213*a*, 213*b* and the spring mounts 219, 221.

FIG. 3 illustrates the components of the conversion kit which are used to transform the shipping crate of FIG. 1 into the present invention.

An outrigger is provided to attach the trailer 203 to a towing vehicle such as a truck. The outrigger 205 has at one end a mechanism for attaching the outrigger 265 to the towing vehicle. Such mechanisms are well known in the art. The other end of the outrigger 205 is outfitted with a hinge mechanism 207 which attaches to the bottom portion 102 of the crate and allows for tilting movement of the trailer 203. By use of the hinge mechanism, the construction of which is well-known in the art, the rear end of the trailer 203 may be lowered so that the rear end abuts the ground.

Also attached to the outrigger 205 is a locking mechanism 209, such as a spring clamp, which is designed to receiveably engage a plate attachment 211 which is fixably attached to the bottom portion 102. When the trailer 203 tilts such that the end nearest the towing vehicle is in the air and the opposite end is abutting the ground, the plate attachment 211 is in the air attached to the bottom portion 102 of the trailer 203.

Once the bottom portion 102 of the trailer 203 lowers due to the shifting weight of the cargo, the plate attachment 211 slides into the locking mechanism 209. By now engaging the locking mechanism 209, the plate attachment 211 is secured and the bottom portion 102 of the trailer 203 is no longer free to tilt. Such locking mechanisms 209 are well known in the art and may be manually or automatically engaged.

Wheel plates 213*a-b* are provided to allow the front wheels of the cargo vehicle to easily maneuver between the front and rear wheel wells 107. An axle assembly 215, well known in the art, attaches to the bottom portion 102 of the trailer 203 so that wheels may be attached to the axle assembly 215 and be freely rotatable.

The axle assembly 215 is attached to the bottom portion 102 by a pair of leaf springs 220 supported by front spring mounts 219 attached to cross bars 133, 138 and rear spring mounts 221 attached to cross bars 133, 137.

FIG. 4 illustrates the tilting trailer 203 in the loading position whereby the bottom portion 102 abuts the ground. One end of the outrigger 207 is attached to the towing vehicle 301 while the cargo, such as an ATV 303 is loaded at the other end. Other embodiments may be utilized, such as a ramp to ease the initial loading of the cargo 303.

Figure 5:
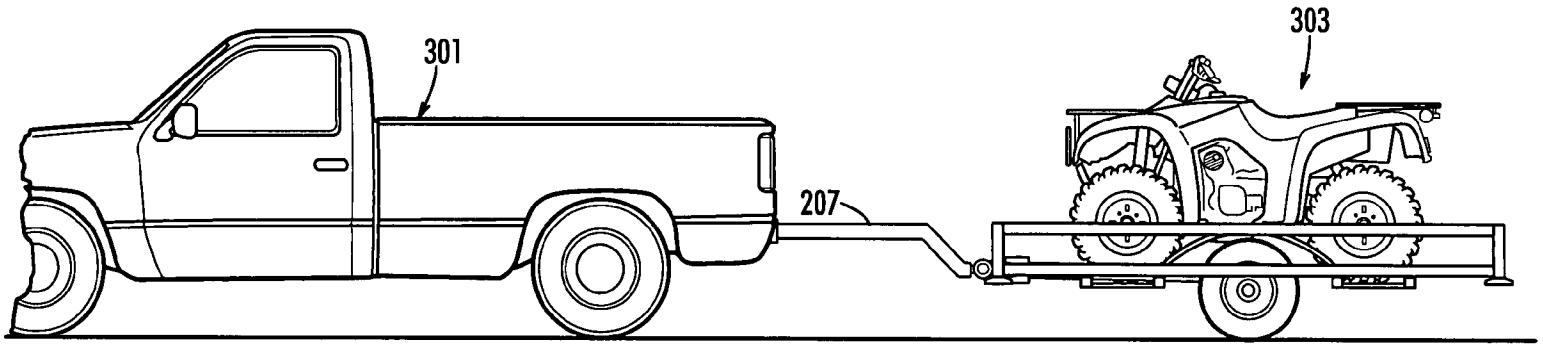
FIG. 5 is a perspective view of the tilting transporting apparatus after the cargo has been loaded.

FIG. 5 illustrates the tilting trailer 203 in the traveling position whereby the bottom portion 102 is level with the ground. The cargo 303 has been loaded and rests securely in the wheel wells 107. Additional straps and other attachments may be used to further secure the cargo 303 to the trailer 203.

Figure 6:
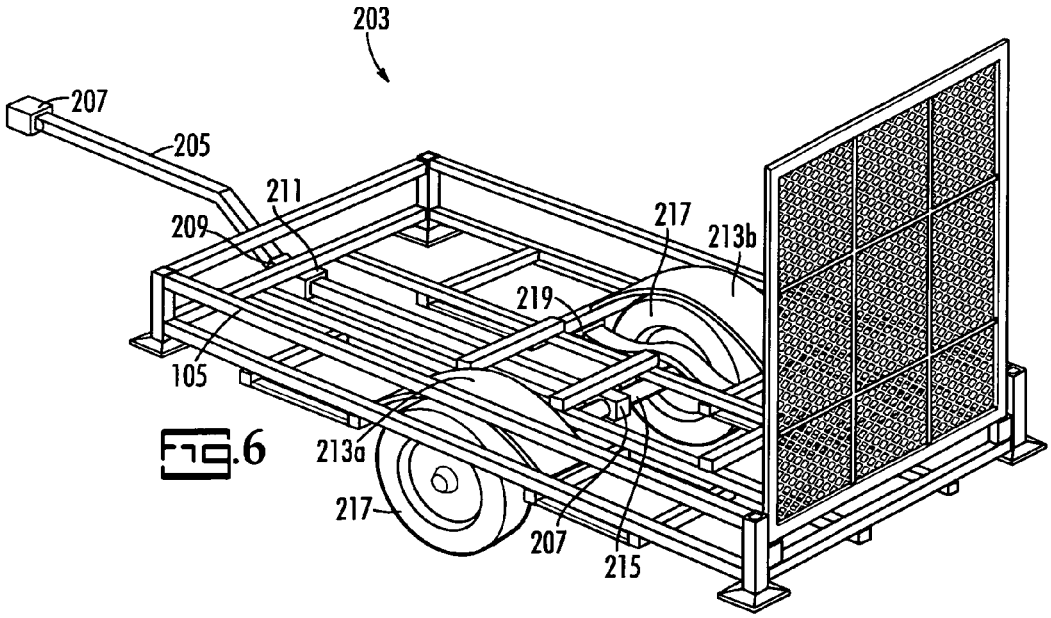
FIG. 6 is a perspective view of the metal shipping crate after modification and application of the conversion kit to form a transporting apparatus with a pivoting ramp.

FIG. 6 illustrates the metal shipping crate after modification and application of the conversion kit to form a transporting apparatus with a pivoting ramp.

The trailer 203 is shown in the transport position with the pivoting ramp 401 attachment. The bottom portion 102 of the crate is essentially unchanged, with the possible exception of corner pocket adaptors 405. The intermediate portions 103*a*-103*d* may be removed or shortened and are fixably attached to the bottom portion 102 and top portion 105. The top portion 105 is also essentially unchanged, with the exception of the removal of any supports which would prevent loading of the cargo, such as the portion of the top rail of the top portion 105 at the back of the trailer 203.

An outrigger is provided to attach the trailer 203 to a towing vehicle such as a truck. The outrigger 205 has at one end a mechanism for attaching the outrigger 205 to the towing vehicle. Such mechanisms are well known in the art. The other end of the outrigger 205 is outfitted with a hinge mechanism 207 which attaches to the bottom portion 102 of the crate. In this embodiment, the hinge mechanism 207 is locked so that no tilting motion is possible. In addition, the hinge mechanism 207 may be omitted altogether.

Also attached to the outrigger 205 is a locking mechanism 209, such as a spring clamp, which is designed to receiveably engage a plate attachment 211 which is fixably attached to the bottom portion 102. In this embodiment, the locking mechanism 209 is maintained in the locked position, such that the plate attachment 211 is secured and the bottom portion 102 of the trailer 203 is not free to tilt. In addition, the locking mechanism 209 and plate attachment 211 may be omitted as long as the outrigger 205 is fixably attached to the bottom portion 102 such that no tilting motion is possible.

Arched wheel plates 213*a-b* are provided to allow the front wheels of the transported vehicle to easily maneuver to the front wheel wells 107 which serve to support and stabilize the vehicle 303. An axle assembly 215, well known in the art, attaches to the bottom portion 102 of the trailer 203 so that wheels may be attached to the axle assembly 215 and be freely rotatable.

A pair of longitudinally extending leaf springs 120 are interposed between the axle assembly 215 and the bottom portion 102, the leaf springs 220 having corresponding front and rear ends mounted in front spring mounts 219 and rear spring mounts 221, respectively.

The tilting ramp 401 may be present in several embodiments. In one embodiment, a corner pocket adapter 405 is fixably attached to the bottom portion 102 such that the intermediate portion 103*a*-103*d* is slidably engaged and attached to the receiving portion of the corner pocket adapter 405. By doing this, the width of entry for the cargo is increased, which may prove important if the cargo is wider than normal due to aftermarket add-ons, for example.

The part of the bottom portion 102 which formerly engaged the intermediate portion 103*a*-103*d* is now open. The bottom portion of the ramp 401 contains a hook assembly 501 which slidably engages with the bottom portion 102. When the ramp 401 is in the lowered position, the hook assembly 501 supports the side of the ramp 401 closest to the bottom portion 102 and allows the other side of the ramp 401 to rest on the ground.

When the ramp 401 is raised to the vertical position, as illustrated in FIG. 6, the hook assembly 501 slides into the empty space of the bottom portion 102, providing support for the raised ramp 401 and hiding the hook assembly 501.

A latching mechanism 403 is provided to lock the ramp 401 in the vertical position. To lower the ramp, the latch must be unlatched, the ramp lifted vertically so that the hook assembly 501 is disengaged adequately, and then the ramp 401 is lowered, making sure that the hook assembly 501 remains engaged with the bottom portion 102.

Another embodiment of the tilting ramp 401 does not require the use of the corner pocket assembly 405. In this embodiment, the ramp 401 is fixably attached to the bottom portion 102 with a hinge assembly. The ramp 501 may be lowered and raised after disengaging a locking mechanism such as a bolt or shaft assembly.

Figure 7:
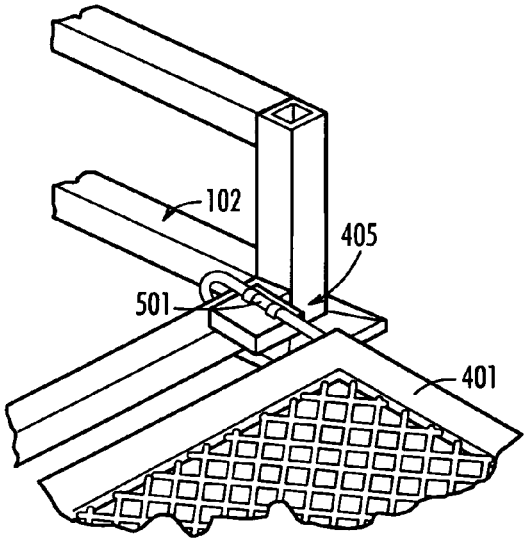
FIG. 7 is a close-up view of a corner pocket adaptor attached to the metal shipping crate after modification and application of the conversion kit to form a transporting apparatus with a pivoting ramp.

FIG. 7 is a closeup view of the corner pocket adapter 405. The ramp 401 has a hook assembly 501 which slidably engages with the bottom portion 102 left vacant due to the corner pocket adapter 405.

It will be apparent to those skilled in the art of shipping crates and tailer assemblies that many changes and substitutions can be made to the foregoing preferred embodiments without departing from the spirit and scope of the present invention, defined by the appended claims.

I claim:

1. A method of converting a metal shipping crate into a rolling transporting apparatus for a vehicle, comprising steps of:

providing said metal shipping crate having:

a rectangular top portion;

a rectangular bottom portion having a generally planar orientation including front rails, rear rails, longitudinally extending side rails, a pair of longitudinally extending laterally inner intermediate rails spaced laterally inward from said side rails, a pair of front wheel wells and a pair of rear wheel wells secured to said side and intermediate rails;

an intermediate portion connecting said top portion and said bottom portion to form a containment volume therebetween, said containment volume defining generally a rectangular parallelepiped;

removing said top portion;

attaching to said bottom portion an outrigger with a first end and a second end, said first end capable of being attached to a vehicle, and said second end including a hinge means such that said bottom portion is tiltable between a generally horizontal transport position wherein said front side abuts said outrigger and forms a planar orientation with said rear side such that said bottom portion is parallel to a level ground surface, and a position wherein said front side is tilted upwardly above said outrigger and said rear side is tilted downward towards said level ground surface;

attaching to said bottom portion a locking means wherein said bottom portion is capable of being fixably attached to said outrigger such that said bottom portion remains in said transport position;

attaching front and rear spring mounts to said front and rear wheel wells, respectively, placing a pair of laterally spaced leaf springs in said sprint mounts, attaching a rolling means to said springs, and attaching a pair of laterally spaced arch plates between said front and rear wheel wheels.

2. The method of claim 1 whereby a manufactured article is oriented onto said support means of said bottom portion.

3. The method of claim 1, whereby a manufactured article is fastened to said bottom portion by straps connected to said bottom portion.

4. The method of claim 1, further comprising adjusting the height of said intermediate portion.

* * * * *